US010550612B2

(12) United States Patent
Reske et al.

(10) Patent No.: US 10,550,612 B2
(45) Date of Patent: Feb. 4, 2020

(54) LATCHING HANDLE ASSEMBLY

(71) Applicant: DOMETIC SWEDEN AB, Solna (SE)

(72) Inventors: Craig Reske, Niles, MI (US); James Tierney, Osceola, IN (US); Clayton Meyers, Middlebury, IN (US)

(73) Assignee: Dometic Sweden AB, Solna (SE)

( * ) Notice: Subject to any disclaimer, the term of this patent is extended or adjusted under 35 U.S.C. 154(b) by 508 days.

(21) Appl. No.: 15/239,625

(22) Filed: Aug. 17, 2016

(65) Prior Publication Data

US 2017/0051542 A1 Feb. 23, 2017

Related U.S. Application Data

(60) Provisional application No. 62/207,714, filed on Aug. 20, 2015.

(51) Int. Cl.

| | |
|---|---|
| ***E05B 7/00*** | (2006.01) |
| ***E05C 3/30*** | (2006.01) |
| ***E05C 3/12*** | (2006.01) |
| ***E05B 63/24*** | (2006.01) |
| ***E05C 3/14*** | (2006.01) |
| ***E05C 3/16*** | (2006.01) |
| ***E05C 19/02*** | (2006.01) |
| ***F25D 23/02*** | (2006.01) |
| *E05B 65/00* | (2006.01) |
| *E05B 65/46* | (2017.01) |
| *F25D 29/00* | (2006.01) |

(52) U.S. Cl.

CPC ..... *E05C 3/124* (2013.01); *E05B 63/244* (2013.01); *E05C 3/145* (2013.01); *E05C 3/162* (2013.01); *E05C 3/30* (2013.01); *E05C 19/02* (2013.01); *F25D 23/028* (2013.01); *E05B 7/00* (2013.01); *E05B 65/0042* (2013.01); *E05B 65/46* (2013.01); *F25D 29/006* (2013.01); *F25D 2323/02* (2013.01); *Y10S 292/71* (2013.01)

(58) Field of Classification Search

CPC . E05C 3/162; E05C 3/30; E05C 3/124; E05B 65/0042; E05B 65/46; Y10S 292/71

See application file for complete search history.

(56) References Cited

U.S. PATENT DOCUMENTS 1,098,703 A * 6/1914 Balfour ..... E05C 3/30 292/124
1,241,192 A * 9/1917 Bruder ..... E05C 19/06 292/124

(Continued)

FOREIGN PATENT DOCUMENTS

CA 2296247 7/2001
CH 234749 A * 10/1944 ..... E05B 65/0042

(Continued)

OTHER PUBLICATIONS

European Patent Office, Interntional Search Report and Written Opinion for PCT/IB2016/054936 dated Nov. 18, 2016.

*Primary Examiner* — Carlos Lugo
(74) *Attorney, Agent, or Firm* — Middleton Reutlinger

(57) ABSTRACT

A latch assembly which provides a locking latch that pivots with movement of the handle and also pivots independently of movement of the handle in order to allow closure of the drawer or door without requiring that the handle be actuated to an open position for closure.

15 Claims, 10 Drawing Sheets

(56) References Cited

U.S. PATENT DOCUMENTS

| | | | | | |
|---|---|---|---|---|---|
| 1,929,775 | A * | 10/1933 | De Voe | E05C 3/162 | 292/224 |
| 1,995,106 | A * | 3/1935 | Roedding | E05C 3/162 | 292/126 |
| 2,010,492 | A * | 8/1935 | Karre | E05C 3/30 | 16/412 |
| 2,679,427 | A | 5/1954 | Johnson | | |
| 4,502,715 | A * | 3/1985 | Lundblade | E05C 3/162 | 292/100 |
| 4,739,896 | A * | 4/1988 | Moss | E02D 29/1427 | 220/324 |
| 4,947,661 | A * | 8/1990 | Yoshida | B60K 37/04 | 248/27.1 |
| 5,234,124 | A * | 8/1993 | Buckner, III | A61B 1/121 | 220/326 |
| 5,292,191 | A * | 3/1994 | Slivon | A47B 95/02 | 292/128 |
| 5,630,630 | A * | 5/1997 | Price | E05B 17/2003 | 292/128 |
| 6,053,544 | A | 4/2000 | Alvring et al. | | |
| D440,238 | S | 4/2001 | Alvring et al. | | |
| 6,296,285 | B1 | 10/2001 | Alvring et al. | | |
| 6,547,289 | B1 * | 4/2003 | Greenheck | E05B 65/46 | 292/100 |
| 6,550,824 | B1 * | 4/2003 | Ramsauer | E05B 65/0852 | 292/100 |
| 6,746,059 | B2 * | 6/2004 | Thomas | A47L 9/1409 | 292/128 |
| 7,048,347 | B1 * | 5/2006 | Liu | B25H 3/028 | 312/332.1 |
| 7,261,332 | B1 * | 8/2007 | Petersen | E02D 29/1427 | 292/121 |
| 7,552,950 | B2 * | 6/2009 | Scheffy | E05B 65/46 | 292/100 |
| 7,552,951 | B2 * | 6/2009 | Kim | B60R 7/04 | 292/113 |
| 8,136,849 | B2 * | 3/2012 | Hakemann | E05C 3/124 | 292/100 |
| 9,181,731 | B2 * | 11/2015 | Grela | A47B 81/00 | |
| 9,388,609 | B2 * | 7/2016 | Grela | E05C 3/14 | |
| 2007/0227208 | A1 | 10/2007 | Ostberg | | |
| 2008/0083242 | A1 | 4/2008 | Muller et al. | | |
| 2011/0121701 | A1 * | 5/2011 | Chang | E05B 7/00 | 312/332.1 |

FOREIGN PATENT DOCUMENTS

| | | | | |
|---|---|---|---|---|
| CH | 406890 | A * | 1/1966 | E05C 3/30 |
| CH | 514059 | | 10/1971 | |
| CN | 201747157 | | 2/2011 | |
| DE | 1084170 | B * | 6/1960 | E05C 3/162 |
| DE | 7631103 | | 6/1977 | |
| FR | 1104983 | | 11/1955 | |
| GB | 191004441 | A * | 9/1910 | E05C 3/30 |
| GB | 246079 | A * | 1/1926 | E05B 17/007 |
| GB | 442310 | | 2/1936 | |
| WO | 2004044356 | | 5/2004 | |
| WO | 2017029626 | | 2/2017 | |

* cited by examiner

LATCHING HANDLE ASSEMBLY

CLAIM TO PRIORITY

This non-provisional patent application claims priority to and benefit of, under 35 U.S.C. § 119(e), U.S. Provisional Patent Application having Ser. No. 62/207,714, filed Aug. 20, 2015 and titled "Latching Handle Assembly", all of which is incorporated by reference herein.

BACKGROUND

Field of the Invention

Present embodiments relate to a door or drawer handle for an appliance. More specifically, present embodiments relate to a latching handle assembly for a drawer or door of an appliance which may be utilized in a recreational vehicle (RV), boat or other recreational craft.

In the manufacture of appliances for RVs and marine craft, some regulations require that the doors have a closed and locked position wherein the door is not capable of being opened without disengaging a locking feature that retains the door or drawer in the closed position during operation of the RV or marine craft. Various handle locking mechanisms have been utilized which can be generally complicated, add weight to the appliance. These lock features may require linkages that extend from the top to the bottom of the door and actuate to disengage and allow opening of the door. Alternatively, are difficult to use while opening the door or drawer. This may be due to ergonomics or complexity of the use of the device.

It would be desirable to provide a closure assembly for an appliance handle which allows for closing of the drawer or door of the appliance and locking as required by local or regional regulations. Still further, it would be desirable to provide locking assembly system which is reliable and allows for improved operation of the locking and unlocking feature.

Still further, it would be desirable to utilize a design which also provides for a partially closed position of the drawer or door to allow air circulation into the appliance when the appliance is not powered or in operation.

The information included in this Background section of the specification, including any references cited herein and any description or discussion thereof, is included for technical reference purposes only and is not to be regarded subject matter by which the scope of the claims are to be bound.

SUMMARY

The present embodiments provide a latch assembly which provides a locking latch that pivots with movement of the handle and also pivots independently of movement of the handle in order to allow closure of the drawer or door without requiring that the handle be actuated to an open position for closure.

According to some embodiments, a handle assembly comprises a handle having a grip portion and at least one biasing structure that biases the handle toward a first of two positions, the at least one biasing structure allowing movement of the handle to a second of the two positions. A locking latch is operably connected to the handle, wherein movement of the handle to the second of the two positions causes movement of the locking latch. Further, the locking latch can move independently of the movement of the handle and the locking latch is biased independently of the at least one biasing structure during the move independently of the handle.

Optionally, the locking latch may further comprise at least a first arm connected to the handle. The locking latch may engage said at least first arm. The locking latch may comprise a spring leg which engages the first arm. The locking latch and the first arm may be mounted on a common pivot axis and to a first mount. The locking latch may have first and second teeth corresponding to first and second door positions.

According to some embodiments, a handle assembly comprises a handle having a grip portion and at least one biasing structure connected to the handle and biasing toward a locked position. A locking latch may be connected to the handle and opposite an appliance catch in an appliance cabinet, the locking latch may move independently of the handle to allow closing of a door or drawer when the handle is biased toward the locked position.

Optionally, the handle may have a first arm and a second arm. The handle may be pivotally connected to one of the drawer or the door. The locking latch may have a first leg which engages the handle and a second leg with at least one latch catch. The handle may pivot to move the first leg. The second leg may move upon engagement of the at least one latch catch with the appliance catch. The at least one latch catch may extend from at least one of the first arm or second arm. The at least one biasing structure may be a spring, for example a torsion spring.

According to still further embodiments, a handle assembly for an appliance comprises a handle having a grip portion and at least one arm, said handle being movable between first and second positions and biased toward one of said first and second positions. A locking latch may be connected to the at least one arm and, a locking catch disposed on the appliance opposite the at least one arm. The locking latch may be movable upon movement of the at least one arm or the locking latch causing the handle to pivot upon engagement with the locking catch.

Optionally, the handle may pivot between a first position and a second position. The locking catch may flex or move from a first position to a second position. The handle may be connected to one of a drawer or a door of the appliance. The handle assembly may further comprise a spring that biases the handle toward one of the first and second positions.

All of the above outlined features are to be understood as exemplary only and many more features and objectives of a latching handle assembly may be gleaned from the disclosure herein. Therefore, no limiting interpretation of this summary is to be understood without further reading of the entire specification, claims and drawings, included herewith.

BRIEF DESCRIPTION OF THE DRAWINGS

In order that the embodiments may be better understood, embodiments of the latching handle assembly will now be described by way of examples. These embodiments are not to limit the scope of the claims as other embodiments of the latching handle assembly will become apparent to one having ordinary skill in the art upon reading the instant description. Non-limiting examples of the present embodiments are shown in figures wherein:

DETAILED DESCRIPTION

Figure 1:
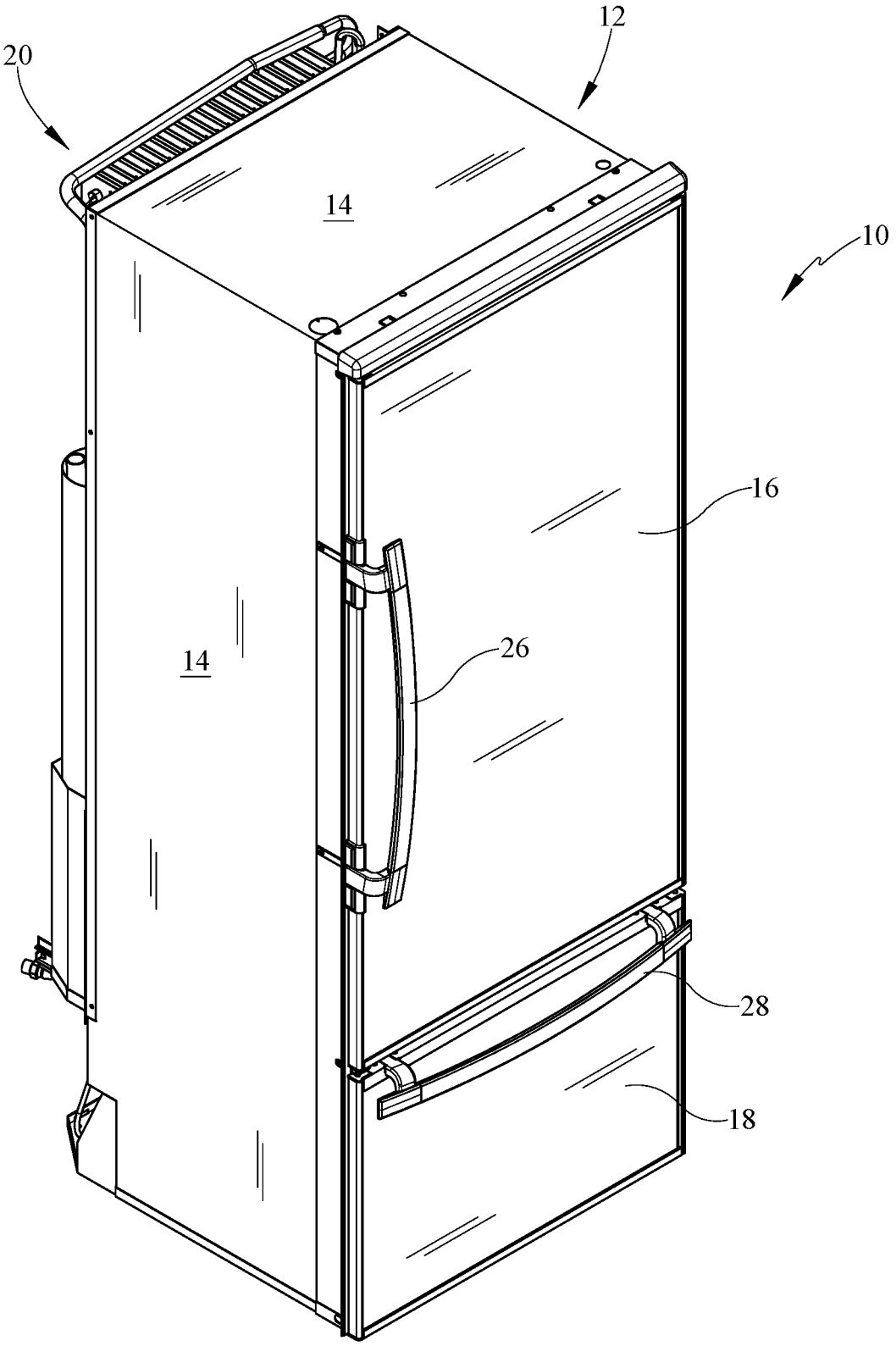
FIG. 1 is a perspective view of an exemplary appliance having at least one door and at least one drawer having embodiments of a latching handle assembly.

It is to be understood that the latching handle assembly is not limited in its application to the details of construction and the arrangement of components set forth in the following description or illustrated in the drawings. The embodiments are capable of other embodiments and of being practiced or of being carried out in various ways. Different embodiments may be combined to form other different embodiments. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Referring now to FIGS. 1-10, various embodiments of a latching handle assembly are shown which may be utilized with an appliance for a recreational vehicle, camper, marine craft or the like. These appliances generally require a locking mechanism to retain doors and drawers in a closed position. The handle assembly allows for the disengagement of the locks by movement of the handle, but further allow for closing of the door or drawer without the need to maintain the handle in an actuated position in order to allow for closure of the door.

With reference now to FIG. 1, an appliance 10 is depicted in perspective view. The exemplary depicted appliance may be a refrigerator freezer but any of various types of appliances may be utilized which include a door and/or drawer structure that should be locked and closed during operation or use of a recreational vehicle or marine craft.

Still further, the latching handle assembly may also be mounted in a cabinet to provide closing for a cabinet door or drawer. Therefore, the term "appliance", as used herein, may include cabinets and drawers among other types of closable storage devices. The appliance 10 includes a cabinet 12 having four walls 14 and a floor. The front face of cabinet 12 may have one or more openings but is shown closed by a door 16 and a drawer 18. The door 16 is pivotally connected to the cabinet 12 to open on a side opposite the door handle assembly 26. The drawer 18 is slidably movable into or out of the cabinet 12 and may be pulled to an open position from the depicted closed position once the drawer handle assembly 28 is actuated to disengage the locking function.

In this embodiment, a single upper door is shown with a lower drawer. However, double doors may be utilized. Still further French doors (side-by-side) are also within the scope of the present embodiments. Likewise, a single door without a drawer, may be utilized, or a door with a horizontal pivot axis, such as an oven, for example. Even further, while the door handle assembly 26 is shown on the left side of door 16 for a right hand pivot location, opposite configurations are also within the scope of the present embodiments.

On the rear side of the cabinet 12 of appliance 10 are cooling mechanicals 20 which provide heat exchange from the inside of the cabinet 12 to the rear exterior of the cabinet 12 and appliance 10. The cooling mechanicals 20 may comprise various types or combination of types. For example, if the appliance is a refrigerator, the refrigerator may be an absorption type refrigerator or a compression type refrigerator or a hybrid combination of these types or others. Thus, the cooling mechanicals 20 are not limited to the specifically listed types but may include other types of systems which provide for heat exchange from the interior of the cabinet 12 to the exterior.

Figure 5:
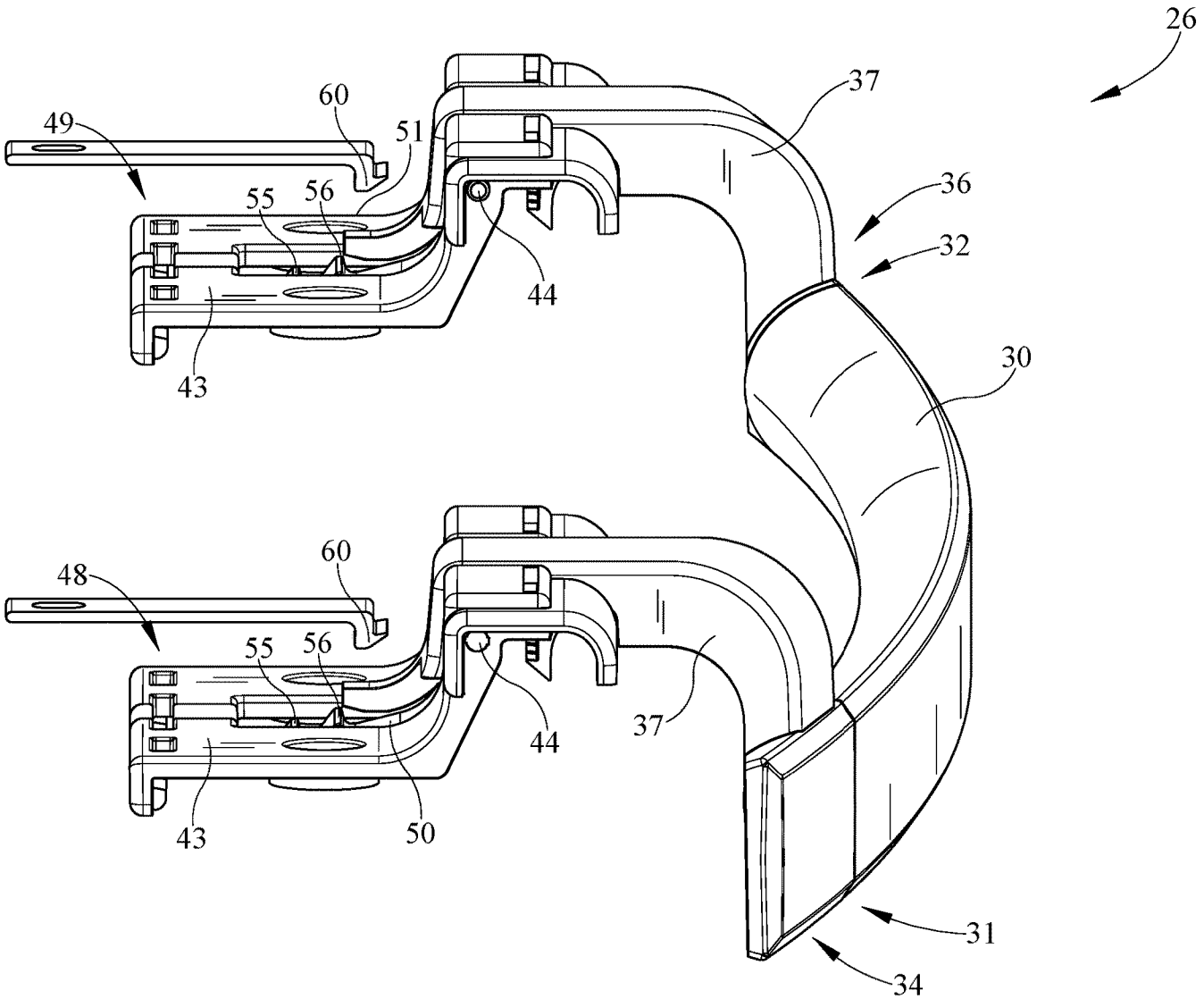
FIG. 5 is a perspective view of the door handle assembly in a third position.

The door 16 includes a door handle assembly 26 and the drawer 18 includes a drawer handle assembly 28. These assemblies 26, 28 provide for the locking functionality of the door 16 and drawer 18, respectively but also allow for disengagement of the locks in order to open each. Further, the door handle assembly 26 and drawer handle assembly 28 also allow for closure of the door and drawer 16, 18 without requiring the handles to be actuated to an unlocked position in order to pass by a locking catch 60 (FIG. 5).

Figure 2:
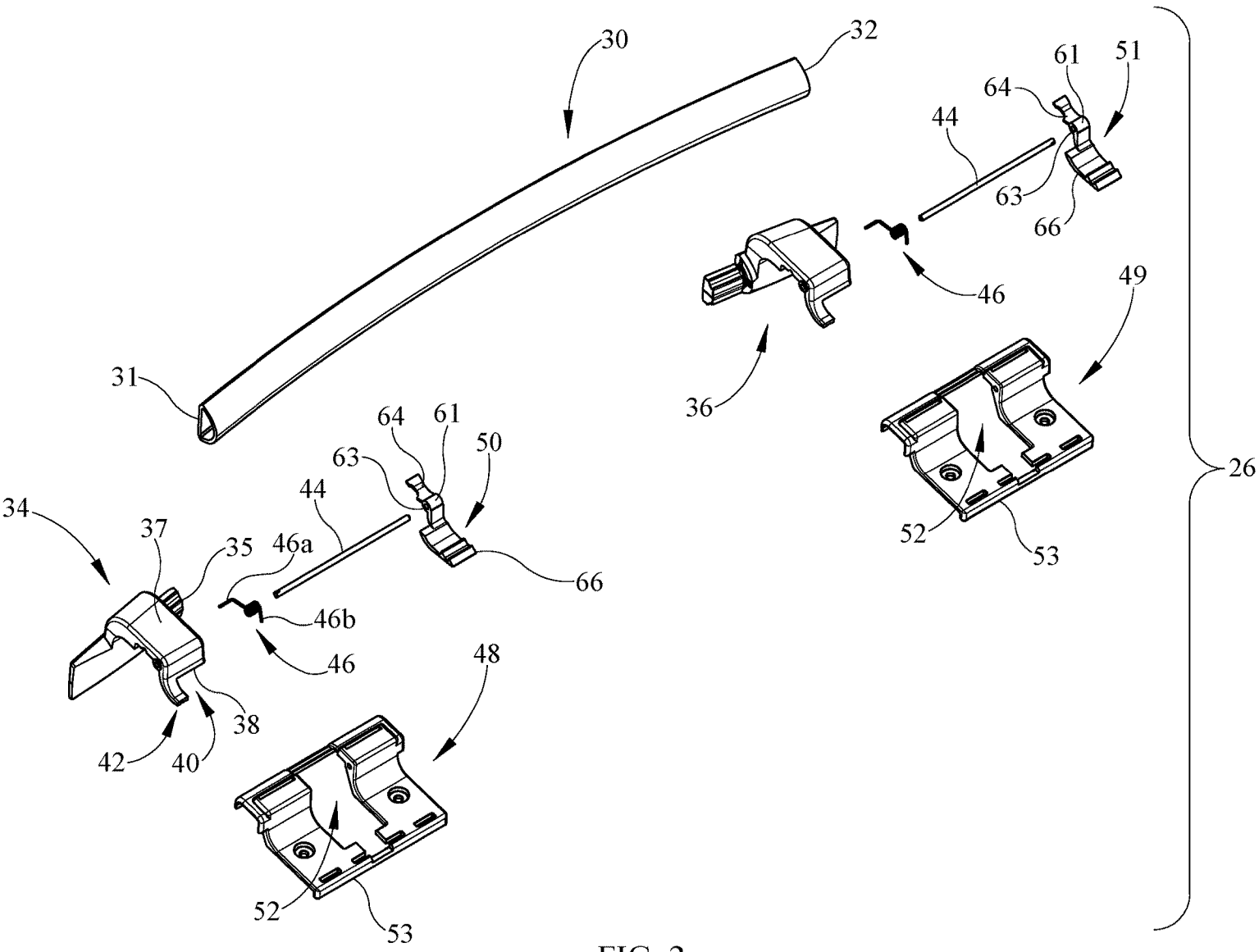
FIG. 2 is an exploded perspective view of the door handle assembly.

Referring now to FIG. 2, an exploded perspective view of the door handle assembly 26 is first shown. The assembly 26 is shown oriented horizontally for purpose of description but may be configured horizontally or vertically (FIG. 1) in operation. The door handle assembly 26 includes a handle 30 having a first arm 34 and a second arm 36 located at or near opposite ends of the handle 30. A grip portion of the handle may be defined between the ends 31, 32. The handle 30 may include a first end 31 and a second end 32 which are either hollow to receive the first and second arms 34, 36 or may be received by the first and second arms 34, 36. The handle 30 may be formed of various materials and may be color coordinated with the outside of the cabinet 12 so as to match the appearance or may be of some alternative color. The handle 30 may have a generally flat front surface extending between ends 31, 32. Further, the handle 30 may also have a curved surface to correspond to the curvature of a hand which grips the handle 30 when opening the appliance door 16. The handle 30 defines a grip portion where a user can either open or close a drawer or door. Various shapes, material, frames and/or colors may be used for the handle 30.

The first arm 34 may include a male connector 35 which is received at the first end 31 of the handle 30. The first arm 34 connects the handle 30 to the remainder of the door handle assembly 26. Similarly, the second arm 36 also connects the handle 30 at the opposite second end 32 to the remainder of these door handle assembly 26. The door handle assembly 26 provides a means to actuate an unlock of the door 16 and further open the door 16. During operation, movement of the handle 30 is facilitated by pivoting relative to first and second mounts 48, 49.

The first arm 34 also includes an elbow 37 which extends from the handle 30 and turns toward a first mount 48 away from the handle 30. The elbow 37 includes a cutaway portion 40 defining a first edge 38 and a finger 42. Adjacent to the finger 42 and extending through the cutaway 40, when assembled, is a locking latch 50. The locking latch 50 is connected by a pivot bar or axle 44 to a biasing structure 46. The biasing structure 46 engages at least one of the mount 48 at one end 46*a*. At a second end 46*b*, the biasing structure 46 engages the first arm 34. This biases the first arm 34 relative to the first mount 48. Also, the locking latch 50 may move relative to the first arm 34. Accordingly, when the handle 30 is actuated, the first arm 34 and locking latch 50 move together. Further, when the locking latch 50 engages a catch 60 (FIG. 5), it moves relative to the first arm 34, for example to allow movement to the closed and locked position, without requiring movement of the handle 30 to accommodate. The biasing structure 46 may take various forms. In some embodiments, the biasing structure 46 may be a torsion spring as depicted. In other embodiments, a metal leaf-type spring may be utilized. Still other biasing structures are considered within the scope of the instant embodiments.

The axle 44 passes through the first mount 48 and the first arm 34 to capture the first arm 34 and first mount 48, allowing the first arm 34 to pivot relative to the first mount 48. Additionally, the axle 44 captures the locking latch 50 and biasing structure 46 allowing movement or function relative to the fixed mounts 48, 49.

The first arm 34 includes the cutaway 40 allowing the locking latch 50 to pass through and extend adjacent to the finger 42. The locking latch 50 is able to engage a catch 60 (FIG. 5) by extending beyond the first arm 34. Both the locking latch 50 and the first arm 34 may pivot about the pivot or axle 44 allowing movement of the handle 30 and first and second arms 34, 36 relative to the first and second mounts 48, 49. The cutaway portion 40 is bounded on one edge by the finger 42 and by the first edge 38 allowing the locking latch 50 to extend therefrom.

The locking latches 50, 51 have a pivot 61 with first and second legs 64, 66. The pivot 61 includes an aperture 63 which receives the axle 44 therethrough. The first leg 64 functions as a spring allowing the second leg 66 to move from a first normal position to a second position and return to the first position. The first leg 64 may engage the first arm 34 to provide the biasing. In the instant embodiment, leg 64 engages an undersurface of the first arm 34. The movement of the latches 50, 51 may therefore be with the movement handle 30 and arms 34, 36, during which time the locking latch leg 64 is not flexed, or may be independent of the handle 30 and arms 34, 36, during which time the locking latch leg 64 flexes. The locking latches 50, 51 may be formed of a generally rigid plastic, metal multi-material embodiments or combinations which allows some bending to provide the biasing movement relative to the first and second arms 34, 36.

The second arm 36 includes similar structures to the first arm 34 and therefore, will not be discussed independently. The second arm 36 engages the handle 30 as previously described and has a biasing structure allowing the second arm 36 and second locking latch 51 to pivot in biased manner.

The first and second mounts 48, 49 allow for connection of the entire door handle assembly 26 to the door 16. The connection may be fastened or snapped onto the door 16, some other connecting means or a combination. Thus, the first and second mounts 48, 49 allow for fixed structures against which the first and second arms 34, 36 and handle 30 may pivot.

The first and second mounts 48, 49 each include a window 52 through which the first and second arms 34, 36 may extend into when the first arm 34, second arm 36 and handle 30 are pivoted to a locked position. As one skilled in the art will recognize, the first mount 48 and second mount 49 are stationary on the door 16 (FIG. 1) and the remaining components pivot relative to the first and second mounts 48, 49. The first and second mounts 48, 49 also include a lip 53 to engage an edge of the door 16. The first and second mounts 48, 49 may be formed in a shape to correspond to an outer edge profile of the door 16, for example. However, this is merely exemplary and various shapes may be used. The first and second mounts 48, 49 may also include fastener apertures which may be used to connect the mounts 48, 49 to an appliance. Still other forms of connection may be used.

Figure 3:
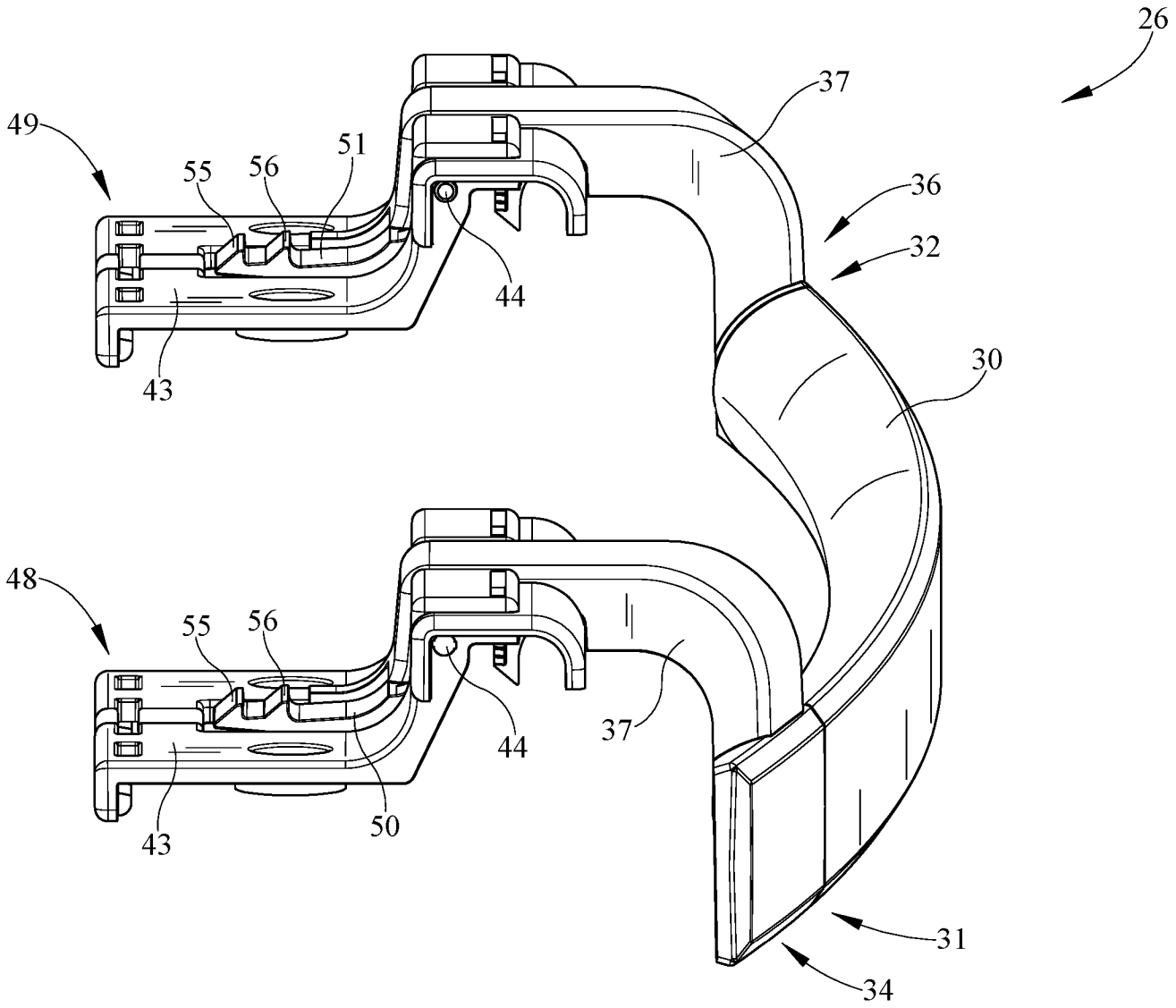
FIG. 3 is a perspective view of a door handle assembly in a first position.

Referring now to FIG. 3, a perspective view of the door handle assembly 26 is depicted. The view shows the handle 30 depicted in an orientation from the first end 31 looking toward the second end 32. Again, while the handle assembly 26 is shown horizontally, the assembly 26 may be oriented vertically as shown in FIG. 1.

As shown in the view, the elbow 37 of each of the first and second arms 34, 36 extend from rear to the handle 30 toward the first and second mounts 48, 49. The first and second arms 34, 36 turn downwardly at the windows 52 (FIG. 2) of the first and second mounts 48, 49 and the locking latches 50, 51 are shown extending from adjacent to the cutaway portion 40 (FIG. 2) further into the windows 52 (FIG. 2). The windows 52 allow the first and second arms 34, 36 to extend therein.

In the depicted position, the locking latches 50, 51 are both shown in a first, normal position and the handle 30 is also shown in such first normally biased position. Each of the first and second mounts 48, 49 has a surface 43 and the locking latches 50, 51 are positioned above the surfaces 43.

Further, each of the locking latches 50, 51 includes first and second teeth 55, 56 which are used to lock the door in corresponding first and second positions of the door 16 (FIG. 1). In the depicted position, the teeth 55, 56 are disposed above surface 43. This allows for locking of the teeth 55, 56 to engage with a catch 60 (FIG. 5) which is mounted opposite the mounts 48, 49.

The view also shows the pivot or axle 44 extending through the first and second arms 34, 36 and through the first and second mounts 48, 49. The biasing structures 46 (FIG. 2) forces the handle 30 to the position depicted allowing the locking latches 50, 51 to stay in the depicted positions and teeth 55, 56 to stay above the surface 43 of the mounts 48, 49. With the teeth 55, 56 above the surface 43, the teeth 55, 56 can engage the opposing part of the refrigerator to retain the door 16 in a closed or partially closed position.

Figure 4:
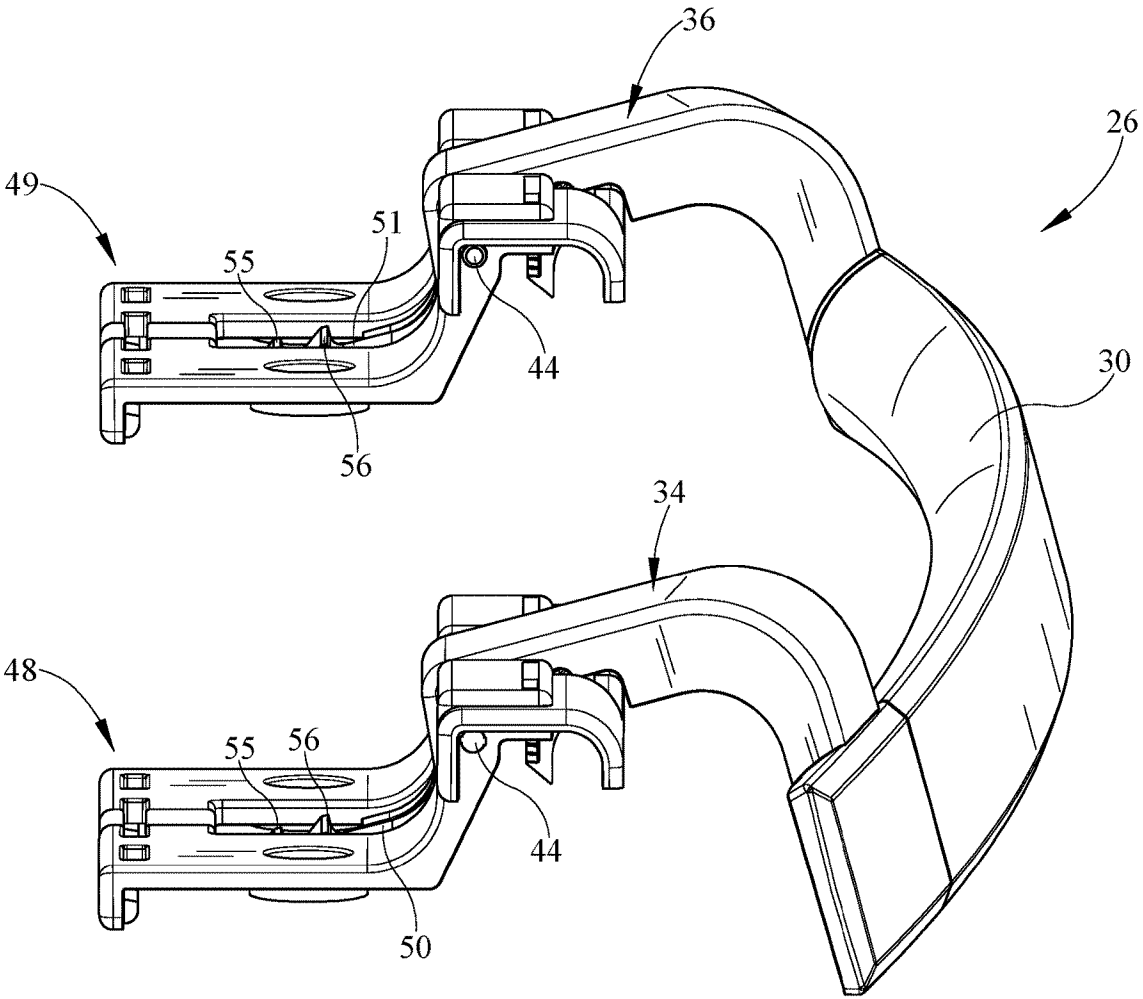
FIG. 4 is perspective view of a door handle enclosure assembly in a second position.

Referring now to FIG. 4, an alternate handle 30 position is depicted. As previously described, one function of the door handle assembly 26 allows for the door 16 (FIG. 1) to be locked when the RV or marine craft is in motion but alternatively, to be unlocked in order to open the door 16. In the embodiment of FIG. 4, the perspective view shows that the handle 30, including first arm 34 and second arm 36, are pivoted relative to the first and second mounts 48, 49. In the depicted embodiment, the first and second arms 34, 36 are rotated about the pivot 44 so that the edge 38 (FIG. 2) engages the upper surface of the locking latches 50, 51. This causes the locking latches 50, 51 to also pivot about the pivots 44 in each of the first and second mounts 48, 49.

Since the locking latch 50, 51 may be engaged by the first and second arms 34, 36, the movement of the handle 30 causes movement of the first and second arms 34, 36 as well as the locking latches 50, 51, respectively. Such movement causes the teeth 55, 56 to dip below the surface 43 (FIG. 3) of the mounts 48, 49. In turn, the teeth 55, 56 disengage locking structures on the opposite structure on the cabinet 12 (FIG. 1), for example catch 60 (FIG. 5) allowing the door 16 to open. Finger 42 (FIG. 2) may also function as a stopping feature so that when it rotates as the handle 30 is actuated, the finger 42 may engage some portion of the door assembly 16 (FIG. 1). This prevents the handle assembly 26 from being over rotated which could cause the locking latches 50, 51 to break.

Referring now to FIG. 5, a perspective view of the door handle assembly is shown. The view depicts a third position of the handle assembly 26, which is not depicted in FIGS. 3 and 4. During the closing of the appliance door 16 (FIG. 1), the handle 30 does not need to be pivoted to the position shown in FIG. 4 in order to close the door 16 (FIG. 1). This functionality makes it desirable for a user since a user does not have to hold the handle 30 in the actuated position while pushing the door 16 (FIG. 1) closed. Instead, the locking latches 50, 51 may pivot about the pivot or axle 44 without need or actuation of the handle 30, and the first and second arms 34, 36. This occurs when the teeth 55, 56 engage the catch 60.

In the depicted embodiment, the locking latches 50, 51 are shown pivoted downwardly so that the teeth 55, 56 are either even with or below the surface 43 of the first and second mounts 48, 49. Shown above the first and second mounts 48, 49 are the locking catches 60 which are mounted to the appliance, for example the cabinet 12 (FIG. 1). The locking catches 60 are shown exploded from a normal distance relative to the teeth 55, 56 and the first and second mounts 48, 49, for ease of description. The locking catches 60 are fixed and in the instant embodiment may not move relative to the first and second mounts 48, 49, the first and second arms 34, 36 and the handle 30. However, some embodiments may allow for flexing of the catch 60. When the door 16 (FIG. 1) is closed, the teeth 55, 56 engage the locking catch 60. During this movement, the teeth 55, 56 move downwardly relative to the surfaces 43 due to engagement with the locking catch 60. The flexing of leg 64 (FIG. 6) causes the teeth 55, 56 and leg 66 (FIG. 6) to move up once the teeth pass the locking catch 60. Once the teeth 55, 56 pass the locking catch 60, the appliance door 16 is closed, for example by magnetic force.

Thus, it should be clear to one skilled in the art that the present embodiments allow for actuation of the handle 30, actuation of the locking latches 50, 51 with actuation of the handle 30 and actuation of the locking latches 50, 51 independent of the handle 30, for example due to engagement with the catches 60.

Figure 6:
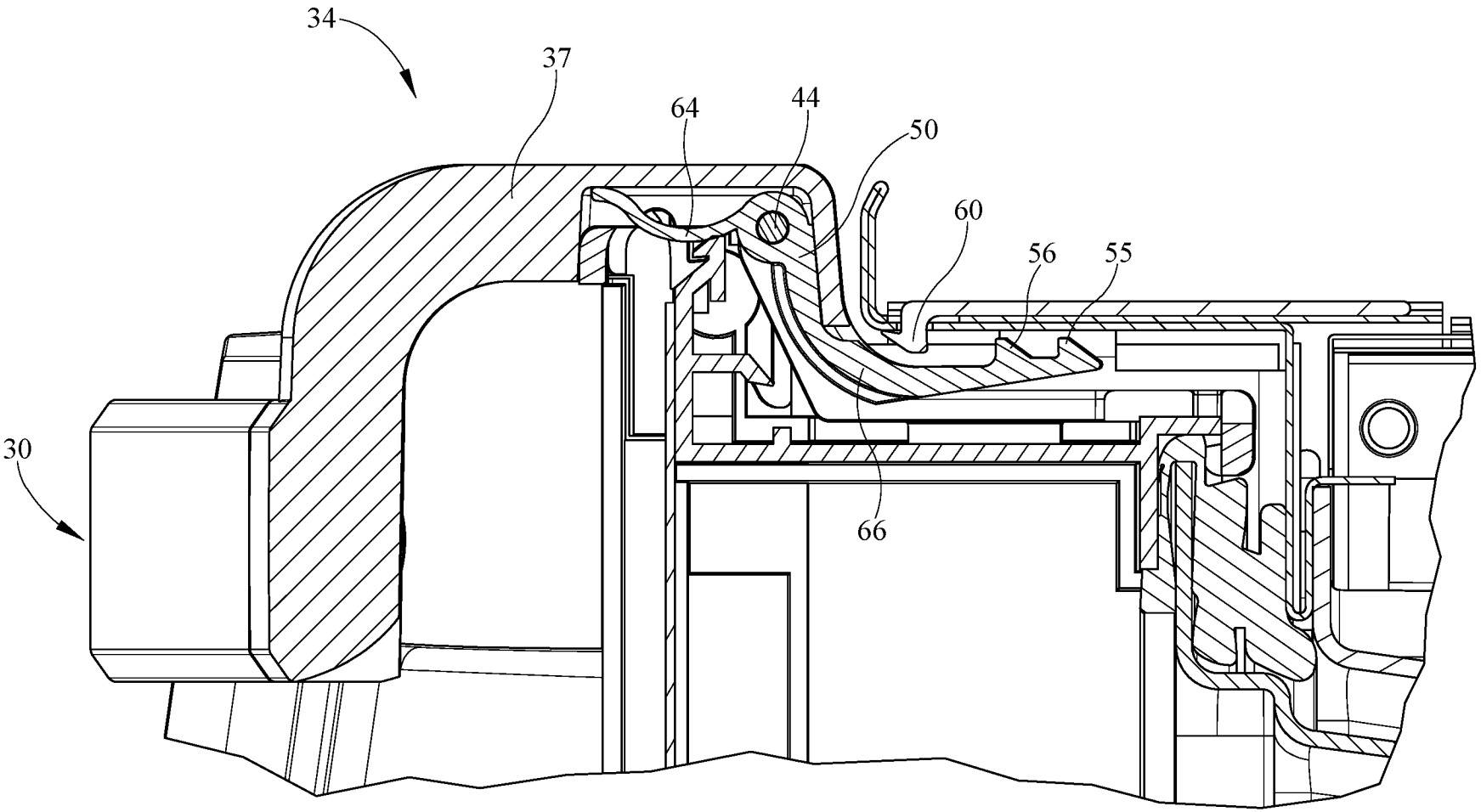
FIG. 6 is a top section view of the refrigerator door depicting the closure in a locked position.
Figure 7:
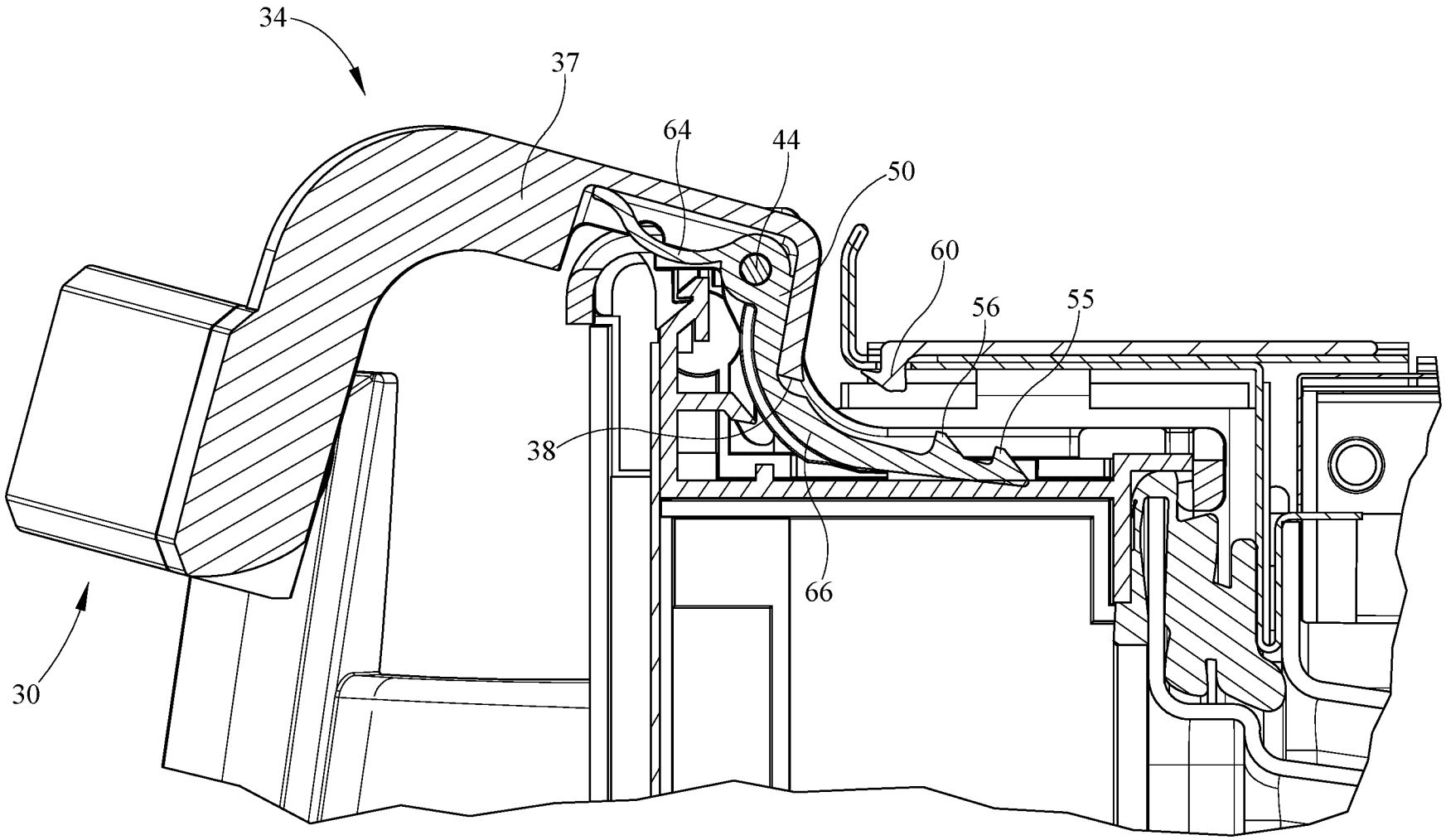
FIG. 7 is a top section view of the handle enclosure assembly in a second, unlocked position.

Referring now to FIGS. 6 and 7, the difference in the first and second positions of FIGS. 3 and 4 are depicted in section views. In FIG. 6, the first locking latch 50 is shown opposite a catch 60 and in the closed position.

In the depicted view, the door 16 is in a closed and locked position with the handle 30 shown in position corresponding to FIG. 4. The locking latch 50 has a first spring leg 64 which engages an undersurface of the first arm 34. Specifically, the spring leg 64 is located under a surface of the arm 34 and engages the first arm 34 which creates a spring force when the locking latch 50 is rotated relative to the first arm 34. During this rotation, the locking latch 50 is turning against the spring force created by spring leg 64. Thus, one skilled in the art will recognize that the locking latch 50 may rotate about pivot 44 and relative to the first arm 34. This allows for movement of a second latch leg 66 of the locking latch 50 without movement of the first arm 34 and handle 30, as described and shown in FIG. 5. This is desirable when closing the door 16 (FIG. 1). When closing, if the locking latch 50 and first arm 34 were rigidly connected, the second latch leg 66 would need to be moved by way of actuation of the handle 30 in order to allow the teeth 55, 56 to move past the catch 60. However, the present embodiment allows movement of the locking latch 50 relative to the first arm 34 so that the second latch leg 66 can move and pass the catch 60 without need to actuate the handle 30.

Additionally, in the view shown, the two teeth 55, 56 are shown extending from the second latch leg 66. The locking latch 50 allows the door 16 (FIG. 1) to be maintained in a completely closed position. For example, the door 16 (FIG. 1) may be opened from a fully closed position if the teeth 55, 56 are moved to disengage from the catch 60. Further, the teeth 55, 56 may engage the catch 60 so that the door 16 is maintained in a partially opened position. This may be desirable when the RV or marine craft is to be left vacant for a long period of time and the appliance 10 (FIG. 1) will not be used during this time. Thus, it is desirable that the door 16 (FIG. 1) be partially opened to allow air flow into and out of the cabinet 12 (FIG. 1) but that the door 16 (FIG. 1) not be able to fully open in an uncontrolled fashion. Thus, the teeth 55 allow for such partially opened position without uncontrolled restraint. The locking latch 51 is similar to locking latch 50 and therefore, the description will not be repeated.

With reference now to FIG. 7, the locking latch 50 is shown in the second position wherein the handle 30 is moved. In this view, with the handle 30 actuated, the edge 38 forces the locking latch 50 to rotate away from the catch 60. This locking latch 50 pivots about pivot 44 and with such movement, the spring leg 64 moves. It should be recognized that since the first arm 34 is moved, the spring leg 64 is not flexed, as shown and described in FIG. 5. With the catch 60 disengaged, the door 16 may be opened.

Figure 8:
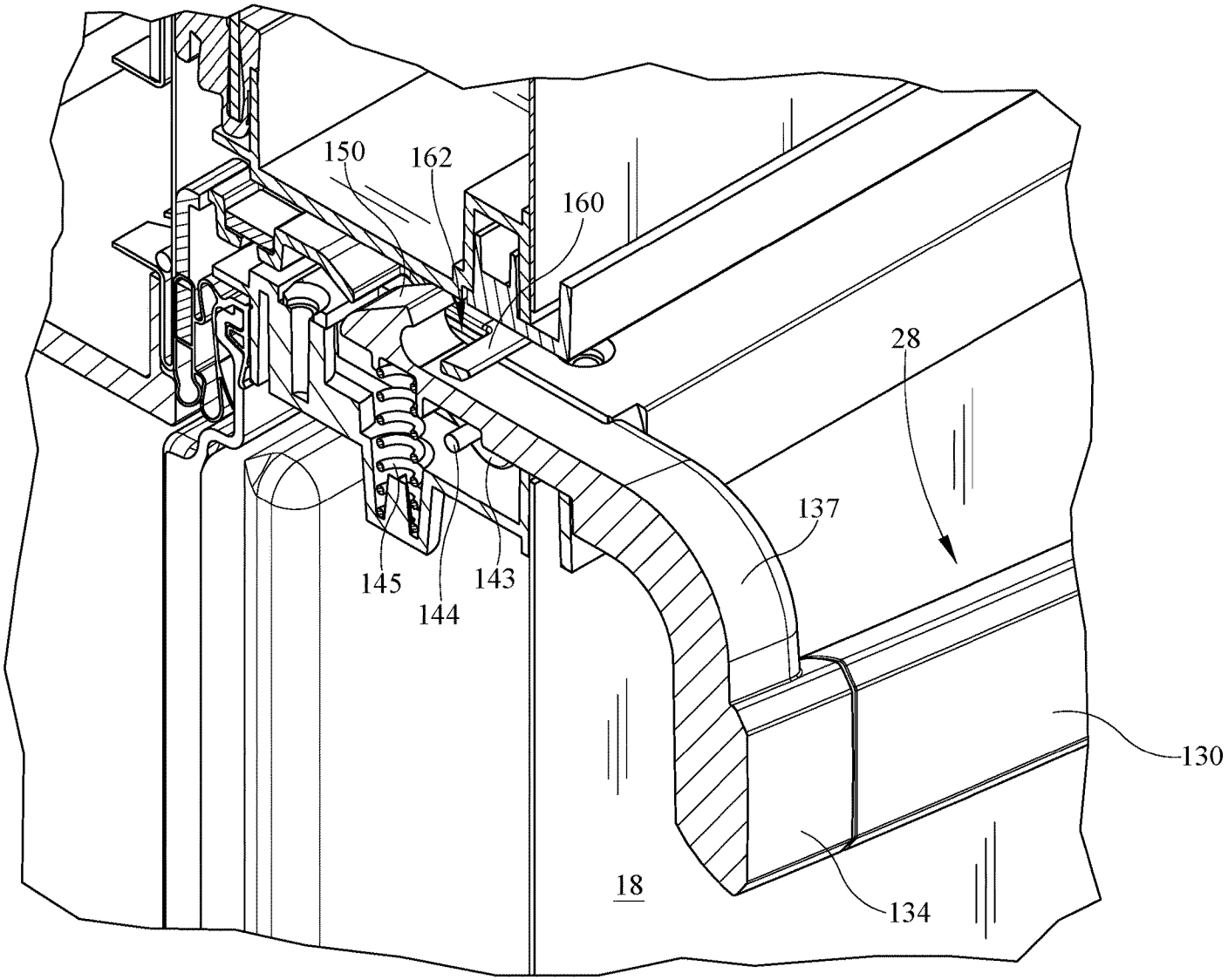
FIG. 8 is a perspective view with vertical section of the handle and closure assembly of the refrigerator drawer in a first position.

Referring again to FIG. 1, the appliance 10 further comprises a drawer 18 and a drawer handle assembly 28. Embodiments are also provided to open the drawer 18. With reference additionally now to FIG. 8, a perspective view which is partially sectioned of the drawer handle assembly 28 is described. The present embodiment utilizes a handle 130 which is connected at first and second ends to corresponding first and second arms 134, 136. The first arm 134 includes an elbow 137 which extends to a locking latch 150. The locking latch 150 engages a catch 160 which is mounted to the cabinet 12 (FIG. 1) of the appliance 10. The catch 160 includes an aperture 162 which allows for passage of the locking latch 150 therethrough. However, other embodiments may include a catch having a tooth rib, protuberance or other structure such as in the previous embodiment.

The drawer handle assembly 28 includes a pivot 144 about which the handle 130 and first arm 134 pivot or rotate. Depending from the locking latch 150 and first arm 134 is a tab 143 which includes an aperture through which the pivot 144 extends. The tab 143 (see also FIG. 9) provides mounting location for the pivot 144 and first arm 134. The first arm 134 is connected to the handle 130. Similar construction may be utilized at the opposite end of the handle 130.

The drawer handle assembly 28 also includes a biasing structure 145 located adjacent to the pivot 144 and first arm 134 closer to the locking latch 150. The biasing structure 145 may be a spring as in the previous embodiment or may be some other biasing structure which maintains the handle 130 in the depicted position such that the first arm 134 is generally horizontal toward the locking latch 150 and further so that the locking latch 150 extends upwardly through the aperture 162 and will engage the catch 160. Present embodiments may include a coil spring which provides an upwardly directed force on the first arm 134. Other biasing structures may be utilized and these descriptions are merely exemplary embodiments. In the depicted embodiment, the biasing structure 145 is a compression spring which provides a force on a lower surface of the latch 150. This upward force retained the latch 150 in an engaged position but allows for pivoting or other translation of the latch 150 and handle 130 to disengage the latch 150 from the catch 160.

Figure 9:
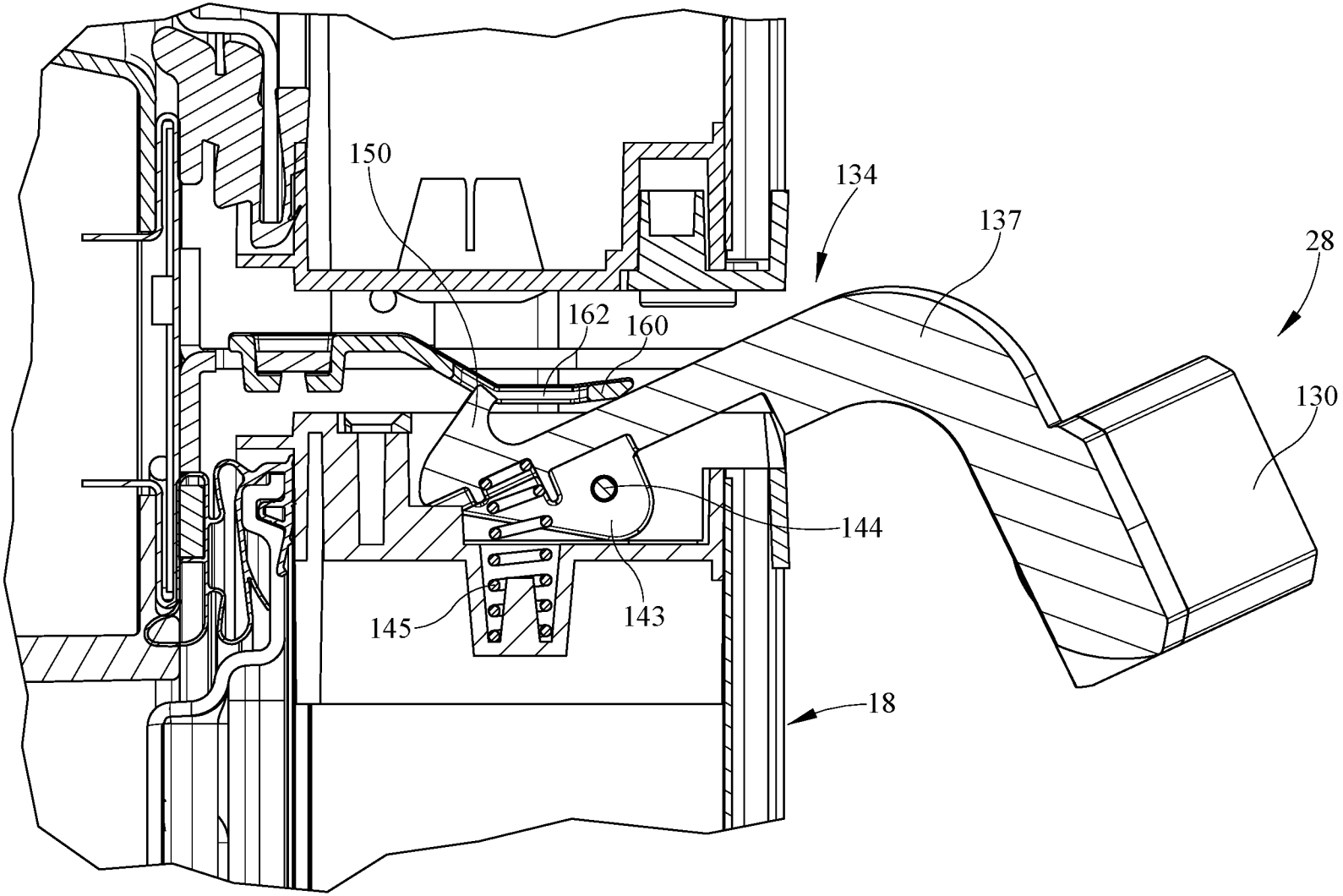
FIG. 9 is an exemplary view of the handle and closure assembly of FIG. 8 in a second, unlocked position; and, FIG. 10 is a perspective view of an alternate positon of FIG. 9.

With reference additionally to FIG. 9, the drawer handle assembly 28 is shown in a second position. The drawer handle assembly 28 and handle 130 are shown actuated to allow opening. In the depicted embodiment, the handle 130 is rotated to a raised position relative to FIG. 8 and the first arm 134, including the elbow 137 is also rotated about the pivot 144. Due to such rotation, the locking latch 150 is moved downwardly from the aperture 162 of the catch 160. With the locking latch 150 moved downwardly therefrom, the drawer 18 may be pulled outwardly (to the right in the depicted embodiment). As shown in the embodiment, the biasing structure 145 may be a spring providing an upward force. The spring 145 may be embodied such that the spring force causes the catch 160 move or bend, or alternatively the spring force may be such that the locking latch moves some distance in addition to the movement of the catch 160.

Figure 10:
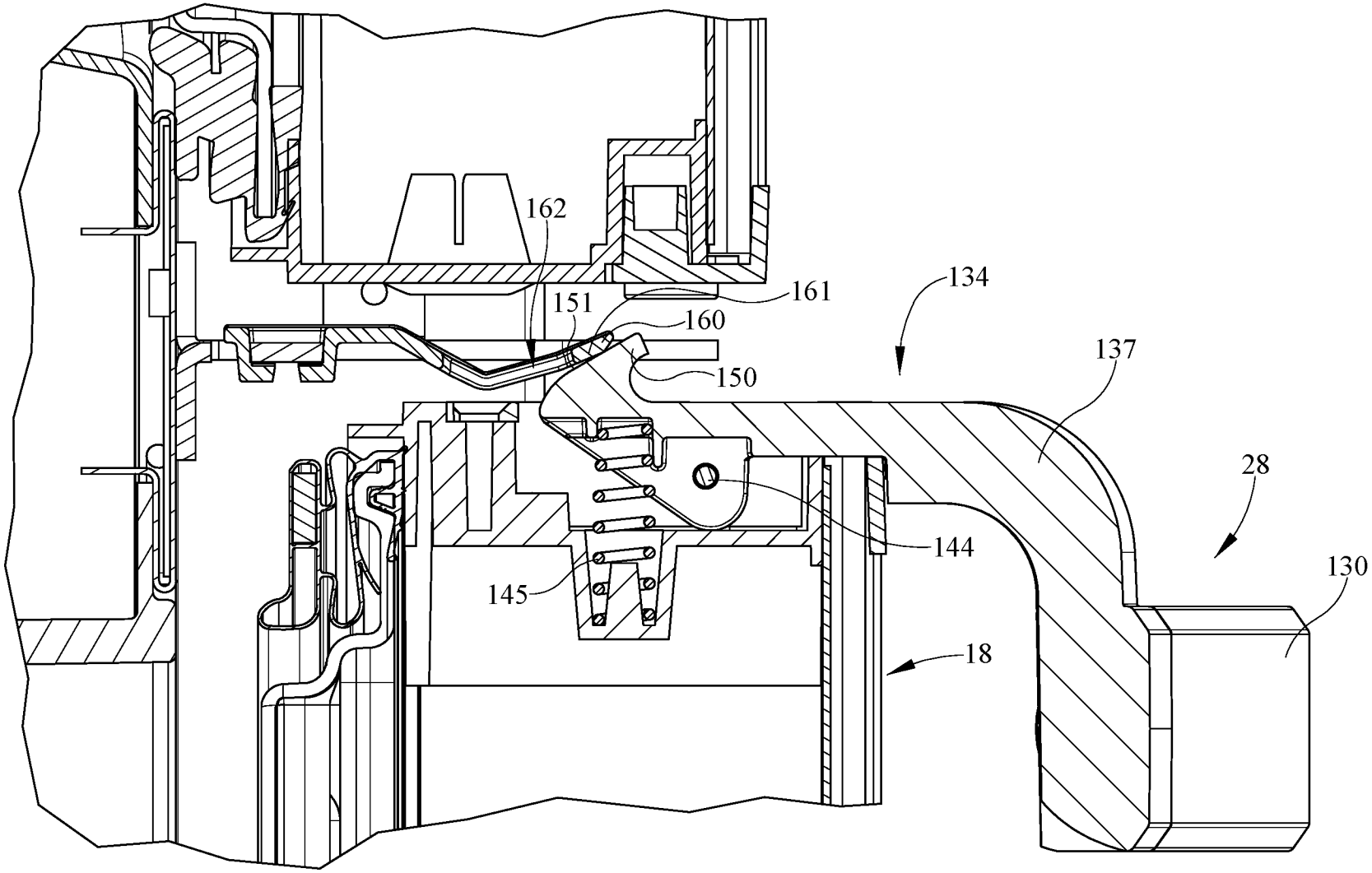

Referring now to FIG. 10, an alternate position is shown in a side section view of the drawer handle assembly 28. In this view, the drawer 18 is being closed (moved to the left) and rather than require the handle 130 to be actuated by a user in order to pass the locking latch 150 by the catch 160, the instant embodiment provides an apparatus which allows for locking of the drawer handle assembly 28 without requiring the user to actuate the handle 130 to an unlocked position. Instead, the catch 160 may flex slightly upwardly, as shown in exaggerated fashion, due to the material from which it is formed and/or the biasing structure of the drawer handle assembly 28 may allow for the handle 130 and first arm 134 to flex and rotate a slight amount. When such occurs, the catch 160 may move upwardly and/or the locking latch 150 may move slightly downwardly. The locking latch 150 has a closing engagement face 151 and the catch 160 may include an opposed engagement face 161. When these two faces 151, 161 meet, either or both of the catch 160 or locking latch 150 may move slightly. Thus, the drawer handle assembly 28 allows for closure of the drawer 18 and locking without necessitating that the user actuate the handle 130 to a position allowing the locking latch 150 to pass by the catch 160 to a locked position.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the invent of embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teaching(s) is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

The invention claimed is:

1. A handle assembly, comprising:

a handle having a grip portion;

first and second arms, each attached near a respective end of the grip portion;

first and second biasing structures operatively connected to said first and second arms respectively, said biasing structures configured to bias said handle toward a first of two positions;

said biasing structures allowing movement of said handle to a second of said two positions;

first and second locking latches operably connected to said first arm and said second arm respectively, wherein movement of said handle to said second of said two positions causes movement of said first and second locking latches; and, first and second mounts pivotally mounting each arm and each locking latch;

wherein said first and second locking latches can move independently of said movement of said handle;

further wherein each of said locking latches is biased independently of said first and second biasing structures, said locking latches being capable of movement when said handle is in said first of two positions;

each of said first and second arms including a cutaway portion defining a finger and an edge;

each of said locking latches having a spring leg which is positioned to engage a respective one of said first and second arms to allow said independently biased movement of said locking latches, said spring leg also being disposed on an opposite side of a pivot location of said locking latch from a tooth that is configured to move between a latched and an unlatched position.

2. The handle assembly of claim 1, wherein said first locking latch and said second locking latch each engage said first arm and said second arm, respectively.

3. The handle assembly of claim 2, wherein said first and second locking latches comprise a second leg having said tooth.

4. The handle assembly of claim 1, wherein said first and second locking latches and said respective arms are mounted on a common pivot axis and to a first mount or a second mount.

5. The handle assembly of claim 1, said locking latch having first and second teeth corresponding to first and second door positions.

6. The handle assembly of claim 1, said first locking latch flexing from a first position to a second position.

7. The handle assembly of claim 1, said handle assembly being connected to one of a drawer or a door of an appliance.

8. A handle assembly, comprising:

a handle having a grip portion;

a first arm attached near an end of the grip portion;

a biasing structure operatively connected to said first arm and configured to bias said handle toward a locked position;

a first locking latch operatively connected to said first arm of said handle and opposite an appliance catch of an appliance cabinet;

a first mount pivotally mounting said first arm and said first locking latch;

said first locking latch movable independently of said handle to allow closing of a door or a drawer when said handle is biased toward said locked position; and said first arm including a cutaway portion defining a finger and an edge;

said first locking latch having a spring leg which is positioned to engage said arm, said spring leg to be deflected to allow said independently biased movement of said first locking latch, said spring leg also being disposed on an opposite side of a pivot location of said first locking latch from a tooth configured to move between a latched and an unlatched position.

9. The handle assembly of claim 8, said handle having said first arm and a second arm.

10. The handle assembly of claim 9, said handle pivotally connected to one of said drawer or said door.

11. The handle assembly of claim 10, said locking latch having a second leg with said tooth.

12. The handle assembly of claim 11, said handle pivoting to move said spring leg.

13. The handle assembly of claim 12, said second leg moving upon engagement of said tooth with said appliance catch.

14. The handle assembly of claim 8, said at least one biasing structure being a spring.

15. The handle assembly of claim 14, said biasing structure being a torsion spring.

* * * * *